US006559448B1

(12) United States Patent
Müller et al.

(10) Patent No.: US 6,559,448 B1
(45) Date of Patent: May 6, 2003

(54) PASSIVE INFRARED DETECTOR

(75) Inventors: Kurt Müller, Männedorf (CH); Martin Allemann, Wetzikon (CH)

(73) Assignee: Siemens Buildings Technologies AG (CH)

( * ) Notice: Subject to any disclaimer, the term of this patent is extended or adjusted under 35 U.S.C. 154(b) by 56 days.

(21) Appl. No.: 09/663,494

(22) Filed: Sep. 18, 2000

(30) Foreign Application Priority Data

Oct. 1, 1999 (EP) ..... 99119496

(51) Int. Cl.[7] ..... G08B 13/00
(52) U.S. Cl. ..... 250/342; 250/353; 250/340
(58) Field of Search ..... 250/338.1, 340, 250/342, 353; 340/567

(56) References Cited

U.S. PATENT DOCUMENTS 4,697,081 A 9/1987 Baker ..... 250/338.3
4,849,635 A * 7/1989 Sugimoto ..... 250/342
4,880,980 A 11/1989 Muller et al. ..... 250/353
4,990,783 A * 2/1991 Muller et al. ..... 250/353
5,187,360 A 2/1993 Pasco ..... 250/208.2
5,923,250 A * 7/1999 Pildner et al. ..... 340/567

FOREIGN PATENT DOCUMENTS

DE 3112529 11/1982

* cited by examiner

*Primary Examiner*—Constantine Hannaher
*Assistant Examiner*—Timothy Moran
(74) *Attorney, Agent, or Firm*—Baker Botts LLP

(57) ABSTRACT

The passive infrared detector contains a heat-sensitive sensor and a focusing device for focusing thermal rays incident on the detector from the room under surveillance onto the sensor. The focusing device has focusing elements for surveillance regions having different positions in the room under surveillance. Each focusing element comprises a number of sub-elements, with the result that the surveillance regions are split up vertically into subzones having slightly different elevation. In a majority of the surveillance regions, the subzones overlap at most only slightly. Human being and animals are distinguished by the amplitude of the sensor signal which is proportional to the number of subzones interrupted by the object in the room under surveillance. The number of sub-elements and correspondingly the number of subzones increases with decreasing radial distance of the respective surveillance region from the detector.

6 Claims, 4 Drawing Sheets

PASSIVE INFRARED DETECTOR

FIELD OF INVENTION

The present invention relates to a passive infrared detector having a heat-sensitive sensor and a focusing device for focusing thermal rays incident from the room under surveillance incident on the detector on to the sensor, and more particularly the focusing device having focusing elements for the surveillance regions having different positions in the room under surveillance.

BACKGROUND OF THE INVENTION

Passive infrared detectors of this type have been known for years and are widespread. They serve, in particular, to detect the presence of unauthorized individuals into the room under surveillance by detecting the typical infrared radiation that is emitted by individuals which is guided by a focusing element onto the sensor. Known focusing devices include Fresnel lenses that are incorporated into the entrance window for the infrared radiation disposed on the front of the detector casing (in this connection, see, for example, EP--A-0 559 110) or a mirror that is disposed in the interior of the detector casing and that comprises individual reflectors (in this connection, see U.S. Pat. No. 4,880,980). Generally, a plurality of rows of reflectors is provided, each row corresponding to a particular surveillance zone, for example, remote zone, middle zone, near zone and look-down zone.

Both the Fresnel lenses and the mirrors are designed so that each surveillance zone is divided into surveillance regions and the room to be kept under surveillance is thus covered in a fanshaped manner by surveillance regions emanating from the detector. Consequently, each reflector determines a surveillance region with a defined position in the room under surveillance. As soon as an object emitting thermal radiation intrudes into the room, the sensor detects the thermal radiation emitted by the object. The detection is most reliable if the object moves transversely with respect to the surveillance region.

Although passive infrared detectors of the present generation can detect intruders within the active region of the detector very reliably, they are not generally able to distinguish human beings from fairly large domestic animals, such as, for example, dogs, and emit an alarm even when an animal is detected. The longer these false alarms are, the less they are tolerated and the protection of passive infrared detectors, against false alarms triggered by domestic animals moving through the room under surveillance, described as domestic animal immunity, has recently developed as an essential requirement of the market. This feature is increasingly being demanded even of passive infrared detectors in the lower price segment of the market.

Those passive infrared detectors that already have domestic animal immunity at present generally achieve this feature by reducing the response sensitivity of the detector, which results in an undesirable reduction in the detection reliability.

In a passive infrared detector having domestic animal immunity described in U.S. Pat. No. 4,849,635, the focusing device is formed by a lens arrangement having a plurality of differently aligned, non-overlapping fields of view or surveillance regions that extend in a fan-shaped manner from the lens arrangement into the room under surveillance. These surveillance regions are staggered vertically, approximately equally such that relatively large gaps are formed between the individual regions. An intruder having a certain minimum height will always cross at least one surveillance region and consequently always generate a sensor signal. An intruder below the minimum height will cross surveillance regions and gaps only alternately and in the latter case will not generate a sensor signal. In this way, a human being, if he moves through the room under surveillance will generate a steady sensor signal having approximately constant amplitude, whereas an animal triggers a pulse-shaped signal of substantially lower maximum amplitude.

Since, in this known system, human beings and domestic animals are distinguished on the basis of the signal shape and since the vertical staggering of the surveillance regions is an equipment constant, there is a relatively great danger that large domestic animals cannot be distinguished from small human beings and vice versa.

OBJECTS AND SUMMARY OF THE INVENTION

The object of the invention is therefore to provide a passive infrared detector of the type mentioned at the outset whose ability to distinguish between human beings and animals is substantially improved.

The object is achieved, according to the invention, in that each focusing element comprises a number of sub-elements so that the surveillance regions are split up vertically into subzones having slightly different elevation and in that the human beings are distinguished from animals on the basis of the amplitude of the sensor signal.

The achievement according to the invention has the advantage that even a very large animal is always reliably distinguished from a human being provided its height is less than that of an human being. After all, a human being walking upright still always crosses a plurality of subzones of remote and middle zones, or middle and near zones, etc., and therefore triggers a much greater sensor signal than an animal of smaller height. The latter will cross markedly fewer subzones and generate a markedly reduced sensor signal. A dog of normal height will cross one subzone or at most two, but this only partly, and will consequently trigger a signal reduced to one half or one third compared with the detector described in U.S. Pat. No. 4,880,980.

A first embodiment of the passive infrared detector according to the invention is characterized in that the elevation of the sub-elements is chosen so that, in the majority of the surveillance regions, at most only an insignificant overlapping of the subzones occurs.

A second embodiment is characterized in that the number of sub-elements and, correspondingly, the number of subzones increases with decreasing radial distance of the respective surveillance region from the detector.

A third embodiment of the detector according to the invention is characterized in that the subzones are arranged in layers in a stack-like manner on top of one another and that the chosen layering is such that a sequence of dense curtains is produced and the sensitivity in the individual subzones being approximately equal. The latter is achieved by avoiding overlapping of the individual subzones.

A fourth embodiment of the detector according to the invention is characterized in that the weighting of the individual sub-elements, in particular their optical aperture and area, is chosen in such a way that an animal that is moving transversely with respect to the coverage pattern formed by the surveillance region and that is of any optional size delivers an approximately equally small signal for all distances between animal and detector. Preferably, the animal is a hair-coated dog with a length of 80 cm and a height of 60 cm.

A fifth embodiment of the detector according to the invention is characterized in that the focusing device is formed by a mirror arrangement having reflectors forming the focusing elements and each reflector is split up into sub-areas. The sub-areas, which are, as a rule, paraboloid sub-areas, can be combined to form groups of mirror regions that are joined together for the production of the injection-molding tool for the mirror arrangement, resulting in a less expensive production and maintenance of the injection-molding tool.

A sixth embodiment is characterized in that the mirror arrangement has a first reflector row for a remote zone, a second reflector row for a middle zone, a third reflector zone for a near zone and a fourth reflector row for a look-down zone and in that the reflectors of the first row and the reflectors of the second row are each split up into three sub-areas and the reflectors of the third row are split up into four sub-areas and the reflector of the fourth row is split up into five sub-areas.

A further embodiment of the detector according to the invention is characterized in that the sensor has four sensor elements that are combined in pairs and that form two independent channels and in that the respective signal is evaluated in each channel.

BRIEF DESCRIPTION OF THE DRAWINGS

The invention is explained in greater detail below by reference to an exemplary embodiment depicted in the drawings; in the drawings.

DETAILED DESCRIPTION OF PREFERRED EMBODIMENTS

Figure 2:
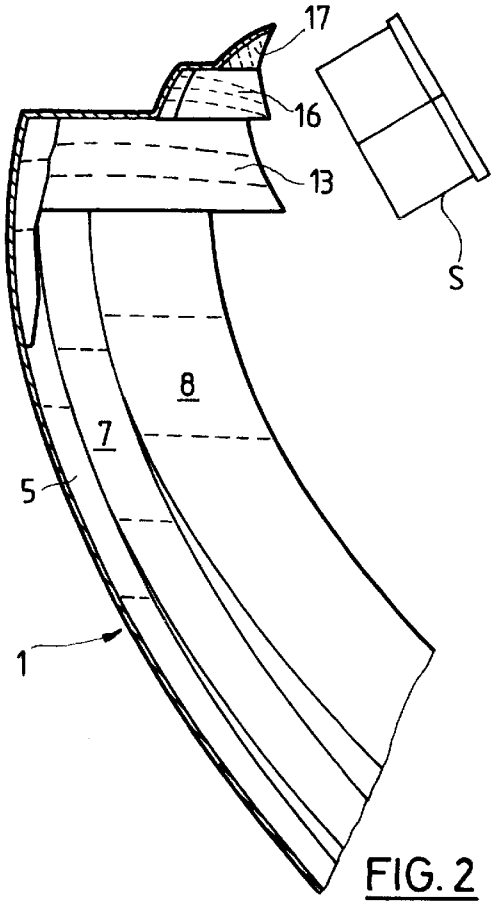
FIG. 2 shows a section along the line II—II in FIG. 1.
Figure 1:
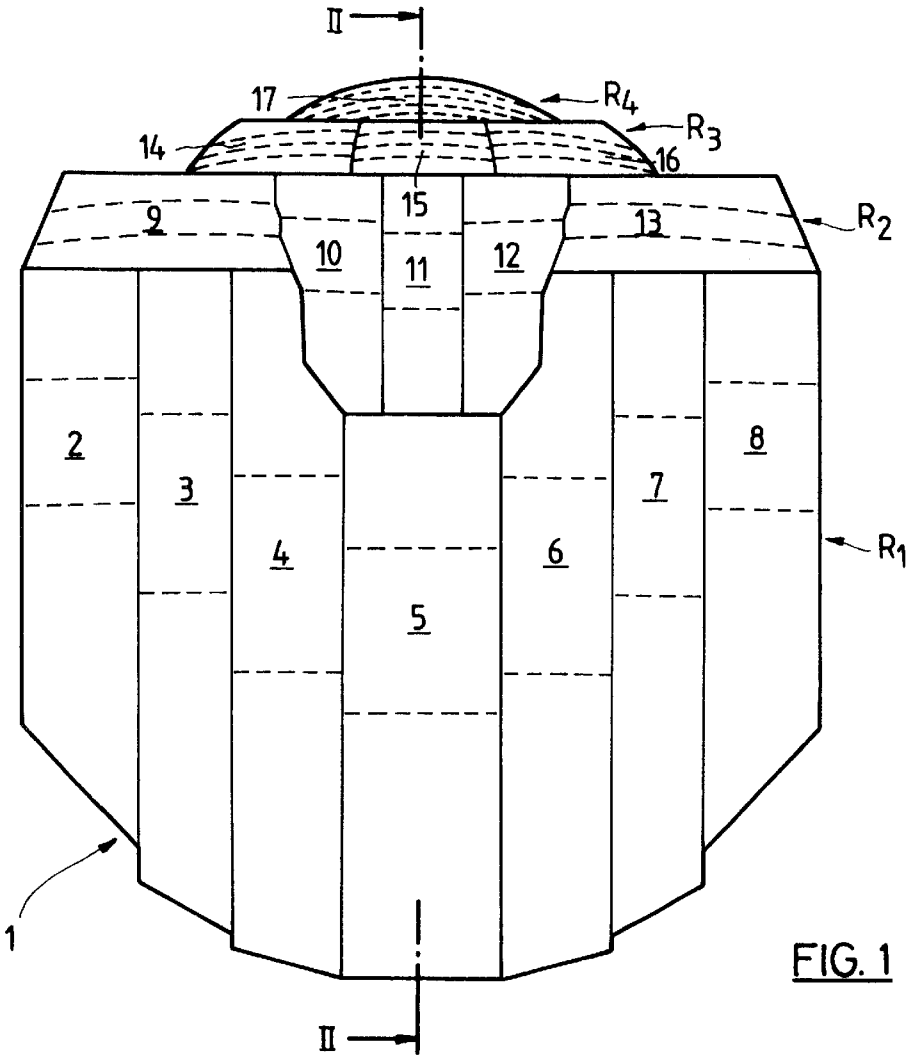
FIG. 1 shows a diagrammatic front view of the focusing of a detector according to the invention formed by a mirror arrangement.

The mirror arrangement 1 depicted in FIGS. 1 and 2 is a further development of the mirror described in U.S. Pat. No. 4,880,980 that improves the mirror in such a way that it is immune to domestic animals in its active region. A Fresnel lens arrangement can also be used as an alternative to the mirror arrangement 1. As described in the U.S. Pat. No. 4,880,980, the disclosure of which is hereby incorporated by reference in its entirety, the mirror arrangement 1 comprises a number of reflectors that are designed so that the room under surveillance is covered in a fan-shaped manner by surveillance regions originating from the detector. A plurality of such "fan areas" or surveillance zones are provided that correspond to different distances from the detector. Four surveillance zones are distinguished, for example, such as a remote zone, a middle zone, a near zone and a so-called look-down zone, that are covered by four rows of reflectors offset in the vertical direction.

In the mirror arrangement 1, the rows are row $R_1$ for the remote zone, row $R_2$ for the middle zone, row $R_3$ for the near zone and the row $R_4$ for the look-down zone, the latter row having only a single reflector. The fan-shaped coverage is achieved by mutually offsetting the reflectors of each row in the horizontal direction with the number of reflectors per row increasing with the distance of the respective surveillance zone from the detector to achieve an approximately uniform overlap pattern.

Each reflector "looks" into a particular solid angle of a particular zone, receives the thermal radiation incident from the corresponding solid angle and focuses it on the heat-sensitive sensor S (FIG. 2), which is formed, for example, by a pyrosensor. The pyrosensor is preferably a so-called standard dual-element pyrosensor, such as is used, for example, in the passive infrared detectors of Siemens Building Technologies AG, Cerberus Division, formerly Cerberus AG (in this connection, see U.S. Pat. No. 4,880,980). As soon as an object that emits thermal radiation enters into a surveillance region, the sensor detects thermal radiation emitted by the object, whereupon the detector emits an alarm signal. The alarm signal indicates that an object, for example an intruder, is in the room under surveillance.

According to the diagram, the reflector row $R_1$ for the remote zone comprises seven paraboloidal strip-type reflectors 2 to 8, the reflector row $R_2$ for the middle zone comprises five reflectors 9 to 13, the reflector row $R_3$ for the near zone comprises three reflectors 14 to 16, and the reflector zone $R_4$ for the look-down zone comprises a single reflector 17. Unlike the arrangement described in U.S. Pat. No. 4,880,980, the individual reflectors do not form a single, uniformly curved area, but have in each case a plurality of sub-areas of different vertical orientation, which splits the assigned surveillance regions up into subzones. The junctions between the sub-areas are indicated in FIGS. 1 and 2 by broken horizontal lines or curves.

Referring in particular to FIG. 1, the reflectors 2 to 8 for the remote zone and the reflectors 9 to 13 for the middle zone each comprise three sub-areas, the reflectors 14 to 16 for the near zone each comprise four sub-areas and the reflector 17 for the look-down zone comprises five sub-areas. Preferably, the individual sub-areas are weighted, i.e., their optical aperture and their area are chosen, in such a way that a dog of a particular size (for example, a hair-covered dog 80 cm long and 60 cm high) moving transversely to the coverage pattern (FIG. 3) produces a signal that is approximately equally small for any distance of the dog from the detector. In one embodiment, the width of the mirror arrangement is 38 mm at its widest point and the various segments illustrated in FIGS. 1 and 2 are scaled accordingly.

Figure 3:
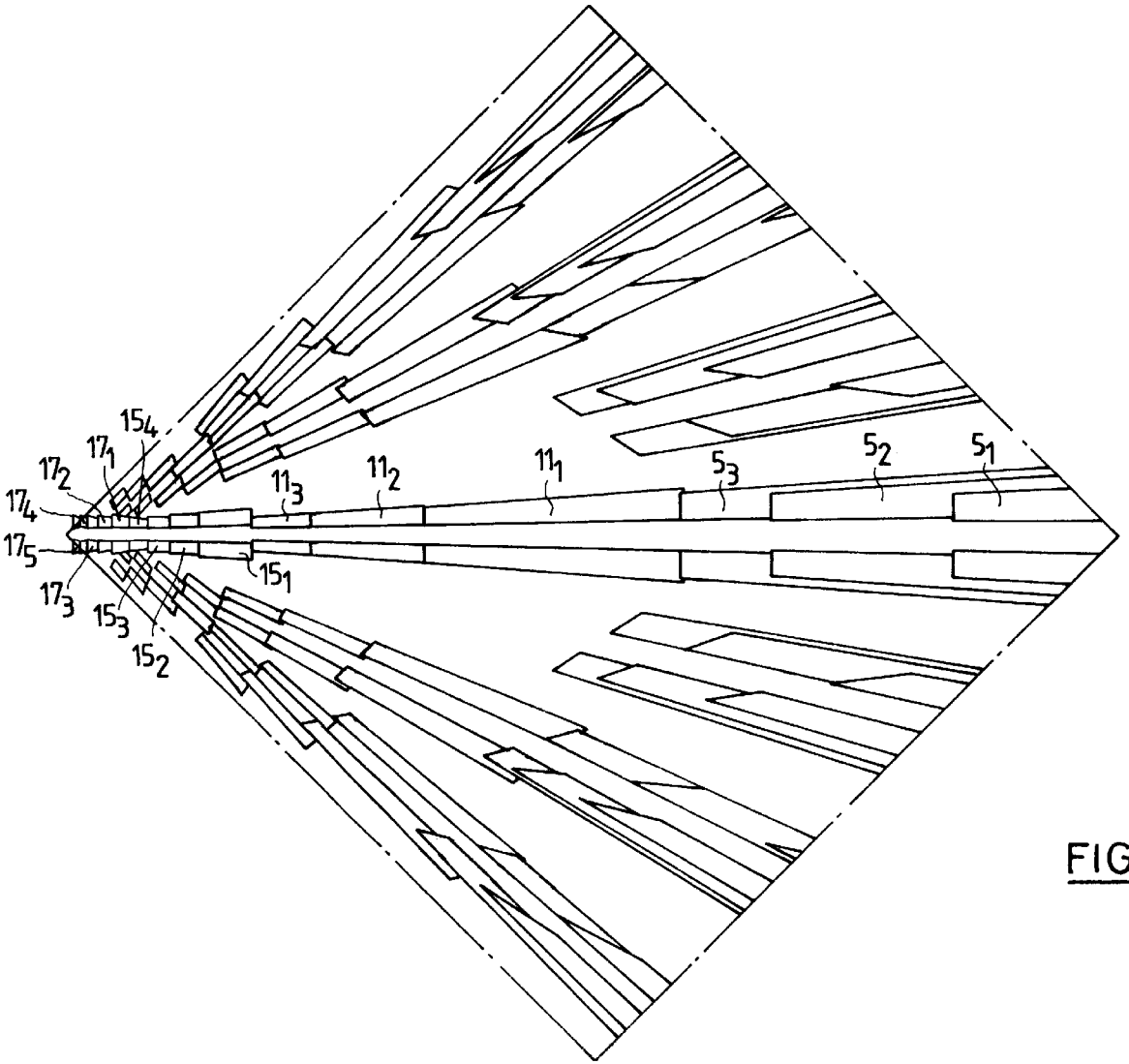
FIG. 3 shows a plan view of the coverage pattern produced by the mirror arrangement in FIGS. 1 and 2.
Figure 4:
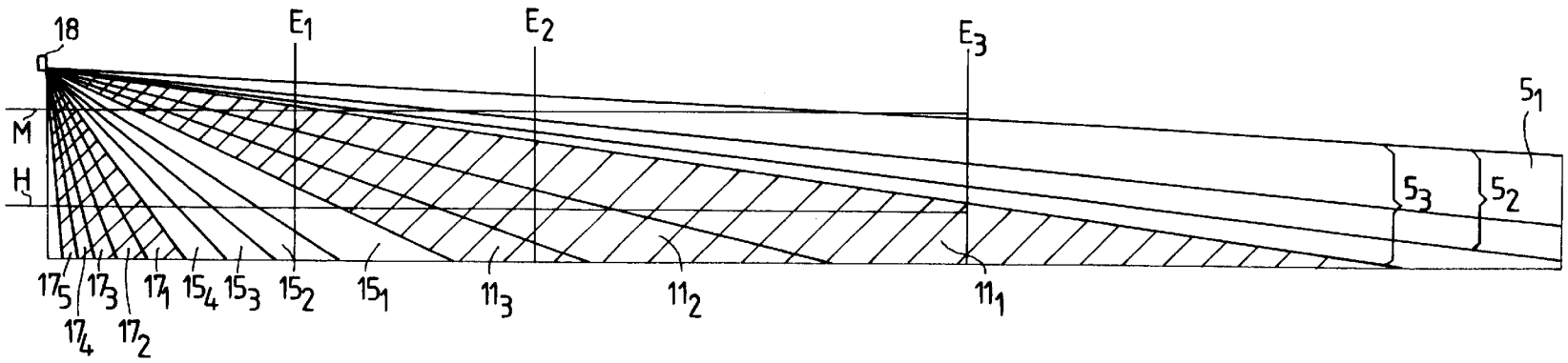
FIG. 4 shows a side view of the coverage pattern in FIG. 3.
Figure 5:
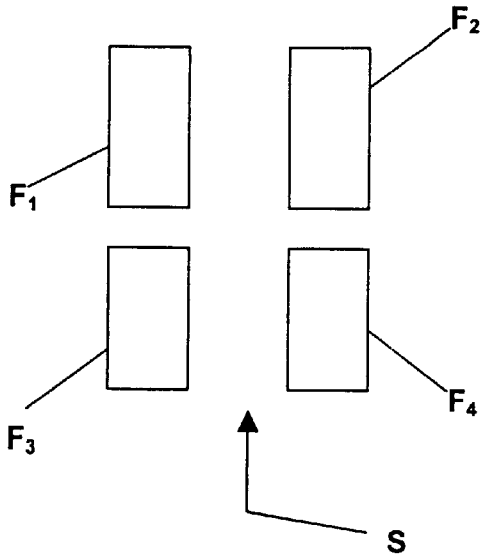
FIG. 5 shows a schematic view of a quad element pyrosensor having four flakes $F_1$ to $F_4$, wherein the upper flakes $F_1$, $F_2$ and the lower flakes $F_1$, $F_4$ each form a channel.
Figure 6:
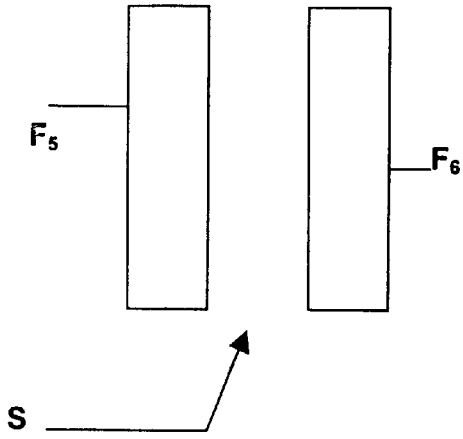
FIG. 6 shows a schematic view of long flake pyrosensors $F_5$ $F_6$.

FIG. 3 shows the coverage pattern of the surveillance regions corresponding to reflectors of the mirror arrangement 1 (FIG. 1) on the floor of the room to be kept under surveillance, and FIG. 4 shows the path of thermal radiation from the surveillance regions to the detector denoted by the reference symbol 18 along the horizontal diagonal of the square shown by a dash-dot line in FIG. 3 and symbolizing a square room under surveillance. The surveillance regions along the diagonal correspond to FIG. 1, denoted by $\mathbf{5}_1$, $\mathbf{5}_2$, $\mathbf{5}_3$ for the remote zone, $\mathbf{11}_1$, $\mathbf{11}_2$, $\mathbf{11}_3$ for the middle zone, $\mathbf{15}_1$, $\mathbf{15}_2$, $\mathbf{15}_3$, $\mathbf{15}_4$ for the near zone and $\mathbf{17}_1$, $\mathbf{17}_2$, $\mathbf{17}_3$, $\mathbf{17}_4$ and $\mathbf{17}_5$ for the look-down zone. Those for the lateral reflectors 2–4 and 6–7 of the row $R_1$ for the remote zone, 9, 10, 12, 13 of the row $R_2$ for the middle zone and 14 and 16 of the row $R_3$ for the near zone are not denoted by reference symbols for reasons of clarity.

If the coverage pattern depicted is compared with that in FIG. 3 of U.S. Pat. No. 4,880,980, it will be seen that the splitting-up of the reflectors into sub-areas results in a substantially denser coverage of the room under surveillance because substantially more surveillance regions are now present in the room under surveillance. If sixteen surveillance regions are present in the detector described in U.S. Pat. No. 4,880,980 ($7R_1+5R_2+3R_3+1R_4$), there are now 53. These 53 parabaloid sub-areas are combined to form 9 continuous mirror regions that can be milled as continuous parts when the injection-molding tool is produced for the mirror 1 (FIG. 1), resulting in less expensive production and maintenance of the injection-molding tool.

The surveillance regions have become substantially longer as a result of splitting up into subzones. As can be observed, in particular, from FIG. 4, the subzones are arranged in layers in a stack-like manner on top of one another. They are in contact with one another, but have minimal overlap with one another, with the result that no regions of greater sensitivity are produced. In the event of overlaps, thermal radiation would, after all, be focused on the sensor from the two respective surveillance regions simultaneously in the overlap region and a correspondingly stronger signal would consequently be produced. The mutual non-overlapping relationship does not apply to the surveillance regions $\mathbf{5}_1$, $\mathbf{5}_2$, $\mathbf{5}_3$ of the remote zone because overlapping cannot be avoided here owing to the oblique path of the beams. Here, because of the geometry of the reflectors 2 to 8, the elevation of the sub-areas is chosen so that the surveillance regions overlap in the manner shown in FIG. 4. Since, however, the remote zone is at a relatively large distance of approximately 12 to 15 m in front of the detector, fluctuations in signal amplitude are not critical here.

In FIG. 4, the detector 18 is at a height of 2.25 m above the floor, and the two horizontal lines H and M correspond to a height of 0.6 and 1.8 m, respectively. These lines symbolize the movement of a dog (H) or human being (M) in the surveillance room. As can be inferred from the figure, in most cases, a dog crosses only one subzone completely or two subzones partially in the active region of the detector. As a result, compared with the mirror arrangement according to U.S. Pat. No. 4,880,980, which has no subzones and therefore a complete surveillance region corresponding to 3 or more subzones is always crossed, the signal of the sensor S (FIG. 1) is reduced by approximately 50% to 70%. On the other hand, an intruder walking upright always crosses a plurality of subzones of the remote and middle zones or middle and near zones or near and look-down zones and consequently produces a many times greater signal than the dog.

The circumstances just described are illustrated in FIG. 4 for three different distances from the detector, $E_1$=2.5 m, $E_2$=5 m and $E_3$=10 m. At the distance $E_1$, a human being (line M) crosses the subzones $\mathbf{15}_2$, $\mathbf{15}_1$, $\mathbf{11}_3$, $\mathbf{11}_2$ and $\mathbf{11}_1$, but a dog (line H) crosses only the subzones $\mathbf{15}_2$ and $\mathbf{15}_1$. At the distance $E_2$, a human being crosses the subzones $\mathbf{11}_3$, $\mathbf{11}_2$, $\mathbf{11}_1$, $\mathbf{5}_3$, $\mathbf{5}_2$ and $\mathbf{5}_1$ and a dog crosses the subzones $\mathbf{11}_3$ and $\mathbf{11}_2$. At the distance $E_3$, a human being crosses the subzones $\mathbf{11}_1$, $\mathbf{5}_3$, $\mathbf{5}_2$ and $\mathbf{5}_1$, but a dog crosses only the subzone $\mathbf{11}_1$.

Practical trials have shown that, within an active region of 12 to 13 m, the sensor signal triggered by a dog having a body weight of approximately 30 kg is at most 50% of the detection threshold, with the result that said dog will not trigger a false alarm. Outside of the active region, the signal due to the dog rises to just below the detection threshold. If the remote zones of the detector can "see out" beyond the active region without limitation by a wall, false alarms due to large dogs cannot be ruled out.

This potential problem can be eliminated by using a quad-element pyrosensor having four flakes or sensor elements as sensor S instead of a dual-element pyrosensor (in this regard, see U.S. Pat. No. 4,880,980 which is hereby incorporated by reference). In a sensor of this type, each pair of sensor elements forms a channel, the two channels corresponding in their action to a vertical splitting-up of the surveillance regions. Of these two channels, the lower "looks" into the floor at approximately 20 m from the detector, with the result that the range is limited if a signal in both channels is required for an alarm. On the other hand, even a large dog will never be able to deliver a signal above the detection threshold in the upper channel, with the result that even large dogs cannot trigger a false alarm outside the detector's active region.

A less expensive, but also less effective, variant compared with the quad-element pyrosensor would be to use longflake pyros. In the case of standard flakes, the image of a dog of medium size covers markedly more that 50% of the height of the flakes (sensor elements), and the image of a human being walking upright projects far above the height of the flakes, but the part projecting above the flakes does not contribute to the sensor signal. If the height of the flakes were to be doubled, for example, the difference between the signals triggered by a dog and a human being would be substantially larger, which would improve the differentiation. The gain factor (increase in the signal of a human being) compared with a dual sensor would be approximately 1.4, but in the case of the quadsensor it would be 2.5 to 3.

What is claimed:

1. A passive infrared detector comprising a heat-sensitive sensor, and a focusing device for focusing on the sensor thermal radiation emanating from a source in a region of a room under surveillance, the focusing device having focusing elements for surveillance regions having different positions in said room, wherein each focusing element comprises a number of sub-elements so that the surveillance regions are split-up vertically into subzones arranged in a layered manner without spaces between adjacent subzones and at different elevations, said subzones having a sensitivity which is approximately equal, and whereby human beings are distinguishable from other animals on the basis of a sensor signals's amplitude.

2. The passive infrared detector according to claim 1, characterized in that the number of sub-elements and, correspondingly, the number of subzones increases with decreasing radial distance of the respective surveillance region from the detector.

3. The passive infrared detector according to claim 1, wherein the dimensions of the sub-elements, including optical apertures, are chosen in such a way that an object of a predetermined size that is moving traversely to a coverage pattern formed by the surveillance regions results in an approximately equal signal for all distances between an object and detector.

4. The passive infrared detector according to claim 1, wherein the focusing device is formed by a mirror arrangement having reflectors forming the focusing elements and each reflector is split up into sub-areas.

5. The passive infrared detector according to claim 4, wherein the mirror arrangement has a first reflector row for a remote zone, a second reflector row for a middle zone, a third reflector row for a near zone and a fourth reflector row for a look-down zone, and in that the reflectors of the first row and the reflectors of the second row are each split up into three sub-areas, the reflectors of the third row are split into four sub-areas and the reflector of the fourth row is split up into five sub-areas.

6. The passive infrared detector according to claim 4, wherein the sensor has four sensor elements that are combined in pairs and that form two independent channels and in that the respective signal is evaluated in each channel.

* * * * *